US006360385B1

(12) United States Patent
Lewandowski

(10) Patent No.: US 6,360,385 B1
(45) Date of Patent: Mar. 26, 2002

(54) SUPPORT MECHANISM, PARTICULARLY FOR BED SIDE RAILS

(75) Inventor: Jeffrey L. Lewandowski, Delton, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 09/592,041

(22) Filed: Jun. 12, 2000

(51) Int. Cl.[7] ..... A47C 21/08
(52) U.S. Cl. ..... 5/430; 5/428
(58) Field of Search ..... 5/430, 428, 425, 5/662

(56) References Cited

U.S. PATENT DOCUMENTS 3,081,463 A 3/1963 Williams et al.
3,855,654 A 12/1974 Pivacek
5,060,327 A 10/1991 Celestina et al.
5,187,824 A 2/1993 Stryker ..... 5/430
6,253,397 B1 * 7/2001 Barton et al. ..... 5/430

* cited by examiner

*Primary Examiner*—Alexander Grosz
(74) *Attorney, Agent, or Firm*—Flynn, Thiel, Boutell & Tanis, P.C.

(57) ABSTRACT

A deployable and stowable side rail for a patient supporting bed. A plurality of bearing housings are provided each rotatably secured to the patient support frame for movement about parallel axes that extend horizontally and perpendicular to the lateral side edges. A plurality of posts are rotatably supported on respective ones of the post receiving supports on the bearing housings. An opposite end of each post oriented on a common side of the patient supporting surface is pivotally connected to a common elongate rail member also oriented on the common side of the patient supporting surface.

4 Claims, 8 Drawing Sheets

SUPPORT MECHANISM, PARTICULARLY FOR BED SIDE RAILS

FIELD OF THE INVENTION

This invention relates to a side rail construction for a patient supporting surface and, more particularly, a side rail construction for use on a hospital bed.

BACKGROUND OF THE INVENTION

Equipment for use in a patient care facility has been categorized in the past into constructions adapted for limited use. For example, hospital beds located within hospital rooms were ordinarily constructed so as to remain in the room and not be capable of easy transport to and from the room. As a result, it became necessary to transfer the patient from the hospital bed to a patient transport carrier for transporting the patient to a remote location for additional treatment, whereat the patient would likely need to be transferred to an additional supporting surface. It would be desirable to provide a patient supporting surface, namely, a hospital bed, that is usable both in the hospital room as well as usable for effecting transport of the patient from the room to a remote location for additional treatment, including surgery, while remaining supported on the patient supporting surface of, for example, the hospital bed.

In order to effect the safe transport of a patient on the patient supporting surface, it is necessary to provide a side rail mechanism on both lateral sides of the patient from exiting the patient supporting surface either voluntarily or involuntarily. Since the patient will be experiencing additional health care treatment while positioned on the patient supporting surface, it is required that the side rail be retractable and movable to a position free of interference with the health care personnel providing the additional treatment to the patient. Simply collapsing the side rail from its initial deployed position wherein the hand rail thereon is above a plane of the patient supporting surface to a position below the plane of the patient supporting surface is simply not enough. The side rail configuration will interfere with the close access required for the health care personnel to access the patient supported on the patient supporting surface.

Therefore, it is an object of this invention to provide a side rail construction for a patient supporting surface that is elevatable to a deployed position preventing voluntary or involuntary exit of the patient from the patient supporting surface while simultaneously being collapsible to a position providing free and unobstructed access to the patient supported on the patient supporting surface.

It is a further object of the invention to provide a side rail construction, as aforesaid, wherein the side rail itself is retractable to a position beneath the patient supporting surface enabling the health care attendant to move close to the lateral edge of the patient supporting surface for convenient access to the patient supported on the patient supporting surface.

It is a further object of the invention to provide a side rail construction, as aforesaid, wherein the operation of the side rail between its collapsed position and its fully upright deployed position can be accomplished by the health care attendant through the use of only one hand.

It is a further object of the invention to provide a side rail construction, as aforesaid, which is of a durable construction and required little or no maintenance.

It is a further object of the invention to provide a side rail construction, as aforesaid, which is easy to clean.

SUMMARY OF THE INVENTION

The objects and purposes of the invention are met by providing a side rail for a patient supporting bed having a base and a patient support frame mounted on the base. The patient support frame has a patient supporting surface bounded by a head end, a foot end and lateral side edges. A plurality of bearing housings are provided each rotatably secured to the patient support frame for movement about parallel axes that extend horizontally and perpendicular to the lateral side edges. The bearing housings each have a post receiving support thereon whose central axis is movable with the bearing housing between first and second positions, the first position of each central axis being axially aligned with other of the central axes of other of the post receiving supports on other of the bearing housings oriented on a common side of the patient supporting surface. The second position of each central axis is displaced from the first position and is parallel to other of the central axes of other of the post receiving supports on other of the bearing housings oriented on the common side of the patient supporting surface. A plurality of posts are provided, one end of each of which is received and rotatably supported on a respective one of the post receiving supports. An opposite end of each post oriented on a common side of the patient supporting surface is pivotally connected to a common elongate rail member also oriented on the common side of the patient supporting surface. Each elongate rail member is oriented in a first position thereof above a plane of the patient supporting surface when the bearing housings are each in the aforesaid second positions thereof and oriented beneath the plane of the patient supporting surface and directly below the first positions thereof when the bearing housings are in the aforesaid first positions thereof. Each of the elongate rail members are movable to a third position in response to a rotation of respective posts on the post receiving supports of the bearing housings that are in the aforesaid first positions thereof. The third position of each of the elongate rails is oriented intermediate the second positions thereof and a vertically upright plane containing a central longitudinal axis of the patient supporting surface.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DESCRIPTION

Figure 1:
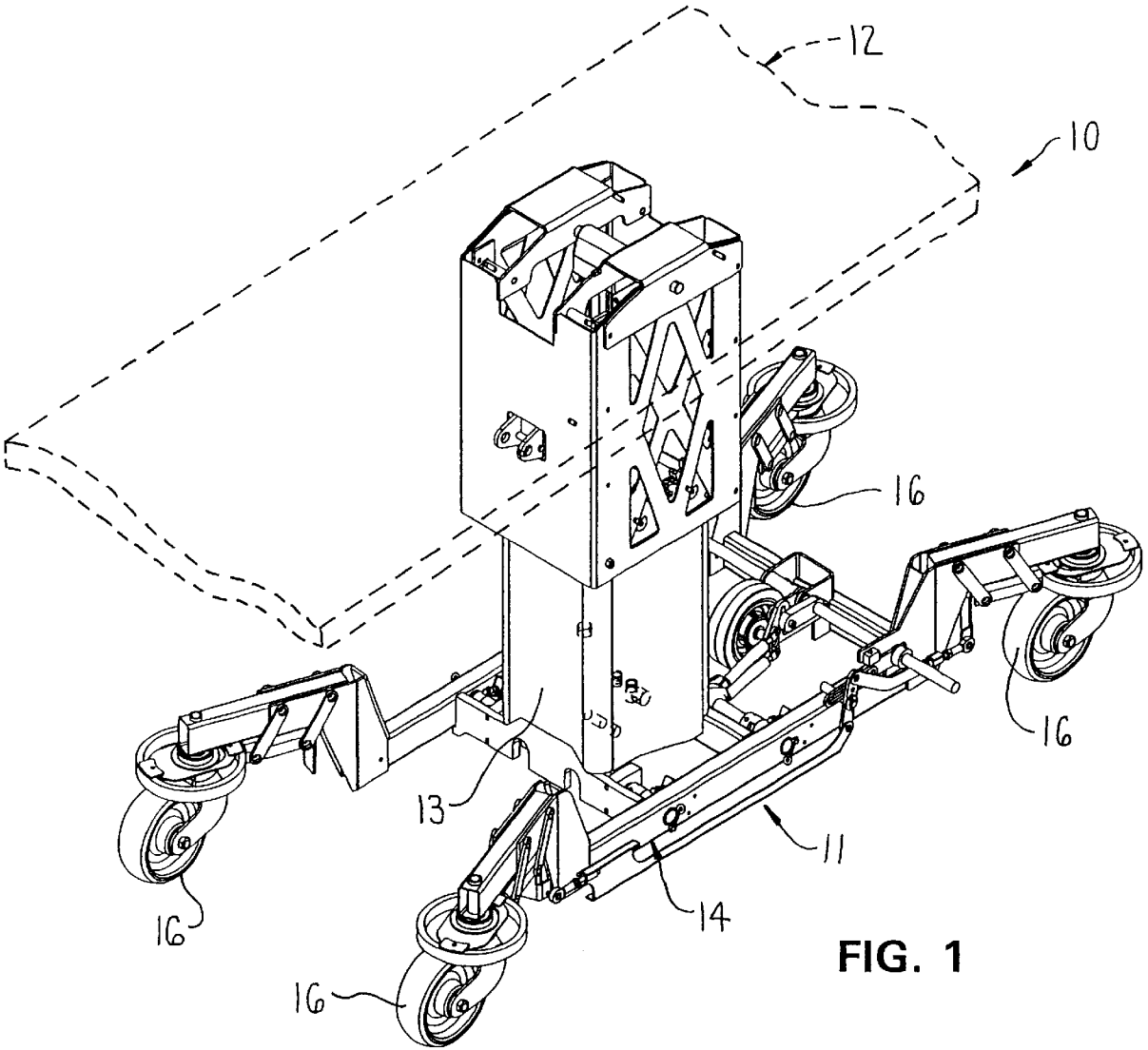
FIG. 1 is an isometric view of a base for a patient supporting bed, the patient supporting surface being schematically illustrated in broken lines.

Certain terminology will be used in the following description for convenience in reference only and will not be limiting. The words "up", "down", "right" and "left" will designate directions in the drawings to which reference is made. The words "in" and "out" will refer to directions toward and away from, respectively, the geometric center of the device and designated parts thereof. Such terminology will include derivatives and words of similar import.

A patient supporting bed 10 is illustrated in FIG. 1 and includes a base 11, a patient support frame 12 (illustrated in broken lines) and a pedestal lift mechanism 13 interconnecting the base 11 to the patient support frame 12. The base 11 includes a frame structure 14 supported on a plurality of wheels 16 for facilitating easy transport of the patient resting on the patient support frame 12 to remote locations for additional treatment.

Figure 2:
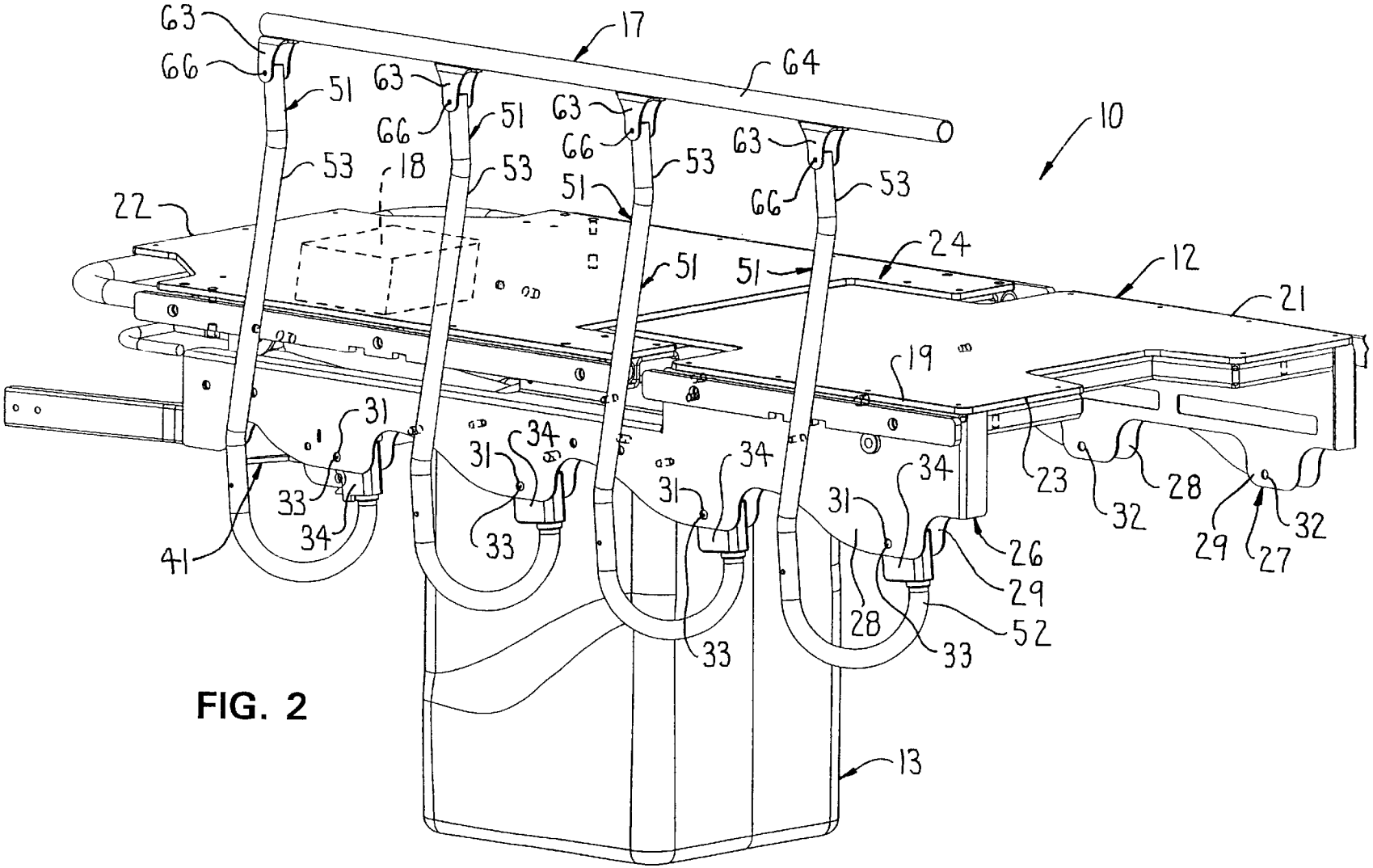
FIG. 2 is an isometric view of a side rail construction embodying the invention adjacent to the patient supporting surface, the side rail construction being oriented in the deployed position.

Referring to FIG. 2, the patient support frame 12 is illustrated in more detail and, in addition, the side rail mechanism 17 is also illustrated in more detail. Since the subject matter of this invention is the side rail construction 17, the following discussion will be limited to that subject.

The patient support frame 12 usually has a mattress 18 positioned thereon on which the patient would be supported. However, for purposes of this disclosure, the patient support frame 12 will be discussed in terms of being the actual patient support surface bounded by lateral edges 19 and 21, a head end 22 and a foot end 23. The lateral edges 19 and 21 as well as the head end 22 and the foot end 23 would also correspond to the edges of the mattress 18 if it wee disposed on the upwardly facing surface 24 of the patient support frame 23.

The patient support frame 12 has a pair of side rail support frames 26 and 27. Each side rail support frame 26 and 27 is identical to the other end and, therefore, only one such side rail support frame 26 will be described in detail. The side rail support frame 26 includes a pair of horizontally spaced and vertically upright plates 28 and 29 each having a plurality of holes 31 and 32 therethrough, the holes 32 being illustrated in association with the plate 29 of the side rail support frame 27. In this particular embodiment, the holes 31 and 32 are axially aligned with one another so as to receive therein an axle member 33.

Figure 7:
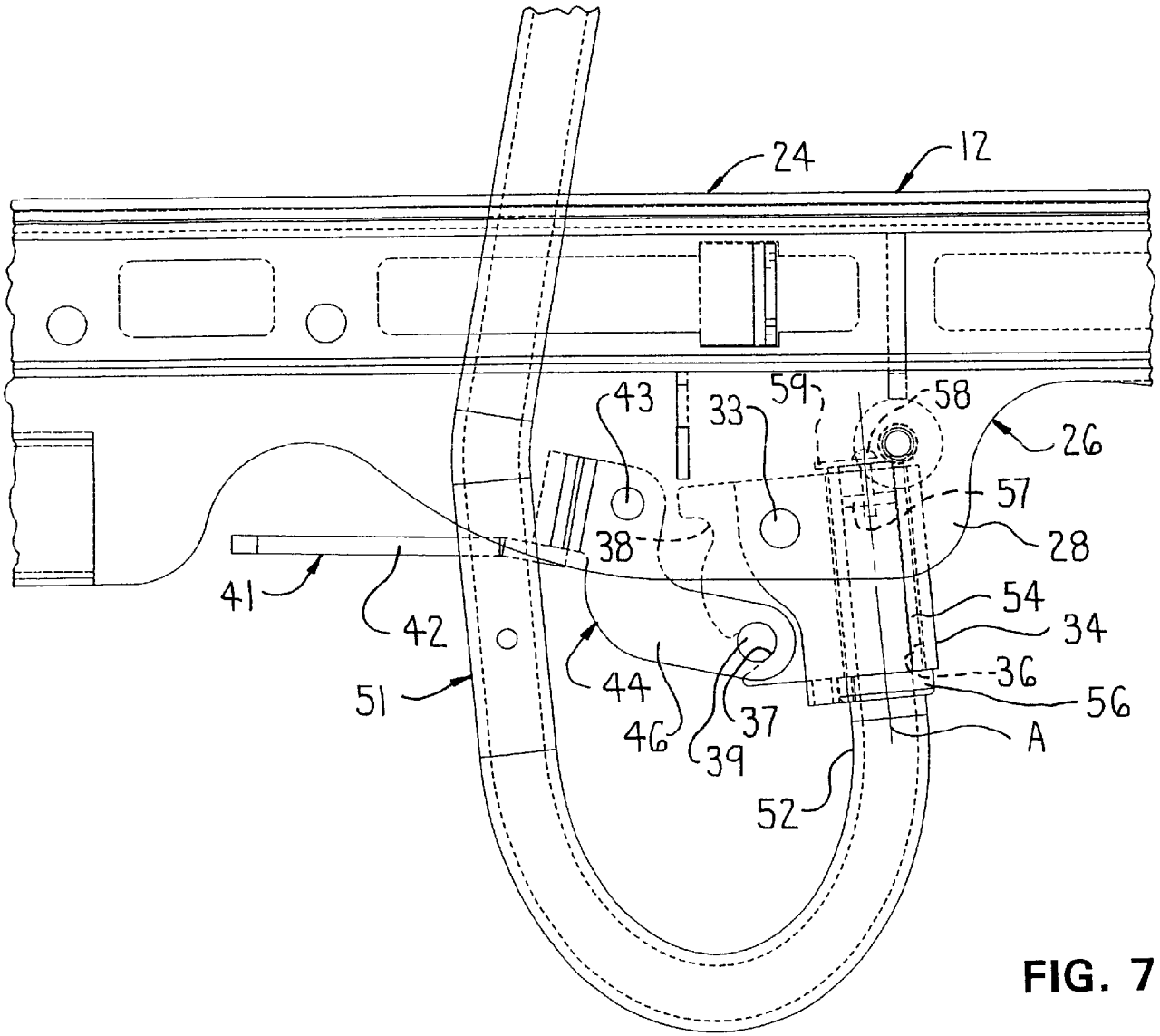
FIG. 7 is an enlarged side view of the deployed side rail.

A plurality of bearing housings 34 are oriented between the plates 28 and 29 and are pivotally supported on the portions of the axles 33 that extend between the plates 28 and 29. FIG. 7 illustrates an enlargement of the area of the patient support frame 12 whereat a bearing housing 34 is pivotally secured by an axle 33 the side rail support frame 26. The bearing housing 34 has an opening 36 extending therethrough, the opening 36 having a central axis A. In this particular embodiment, the opening 36 is circular in cross section.

Figure 6:
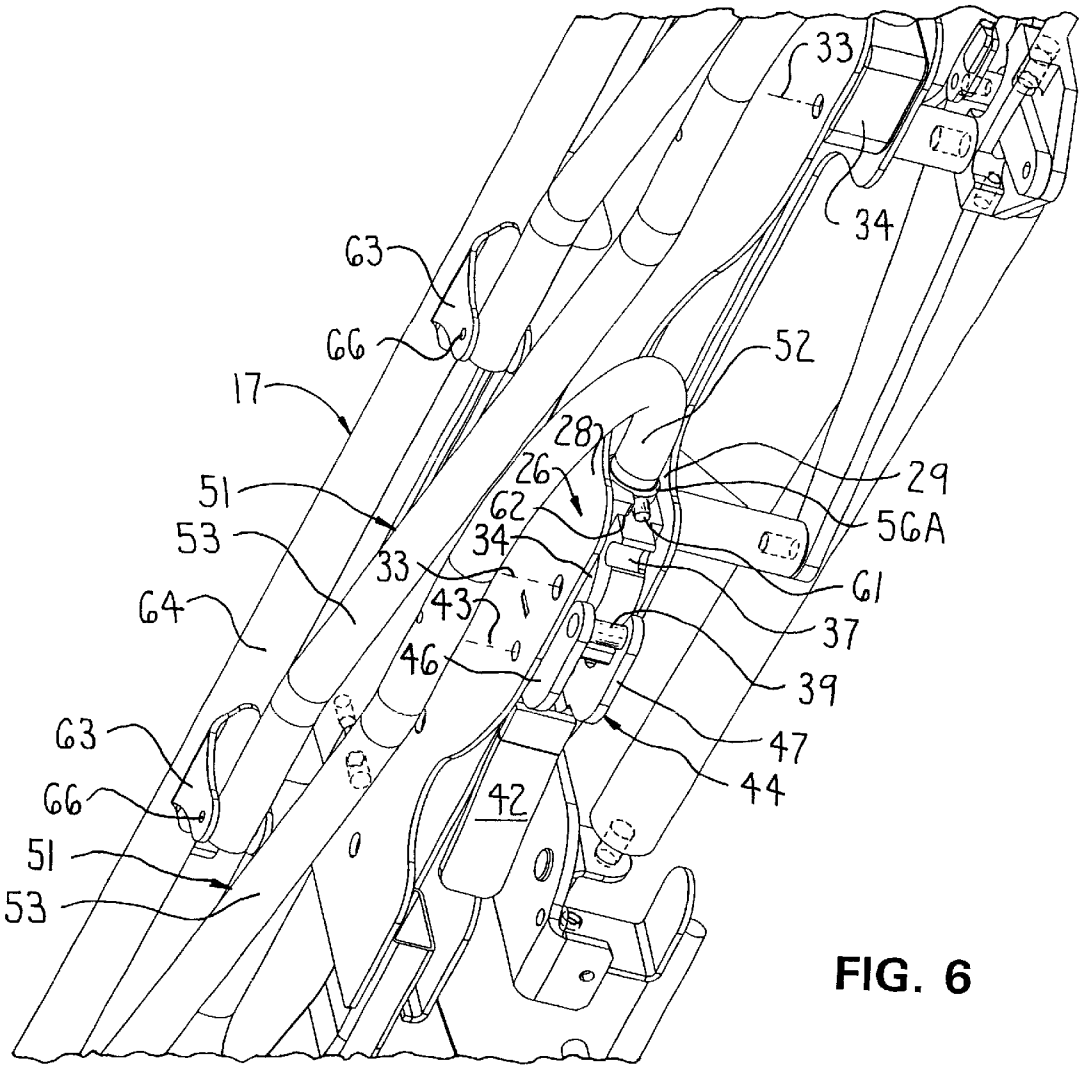
FIG. 6 is a bottom isometric view of the support structure for the side rail.
Figure 8:
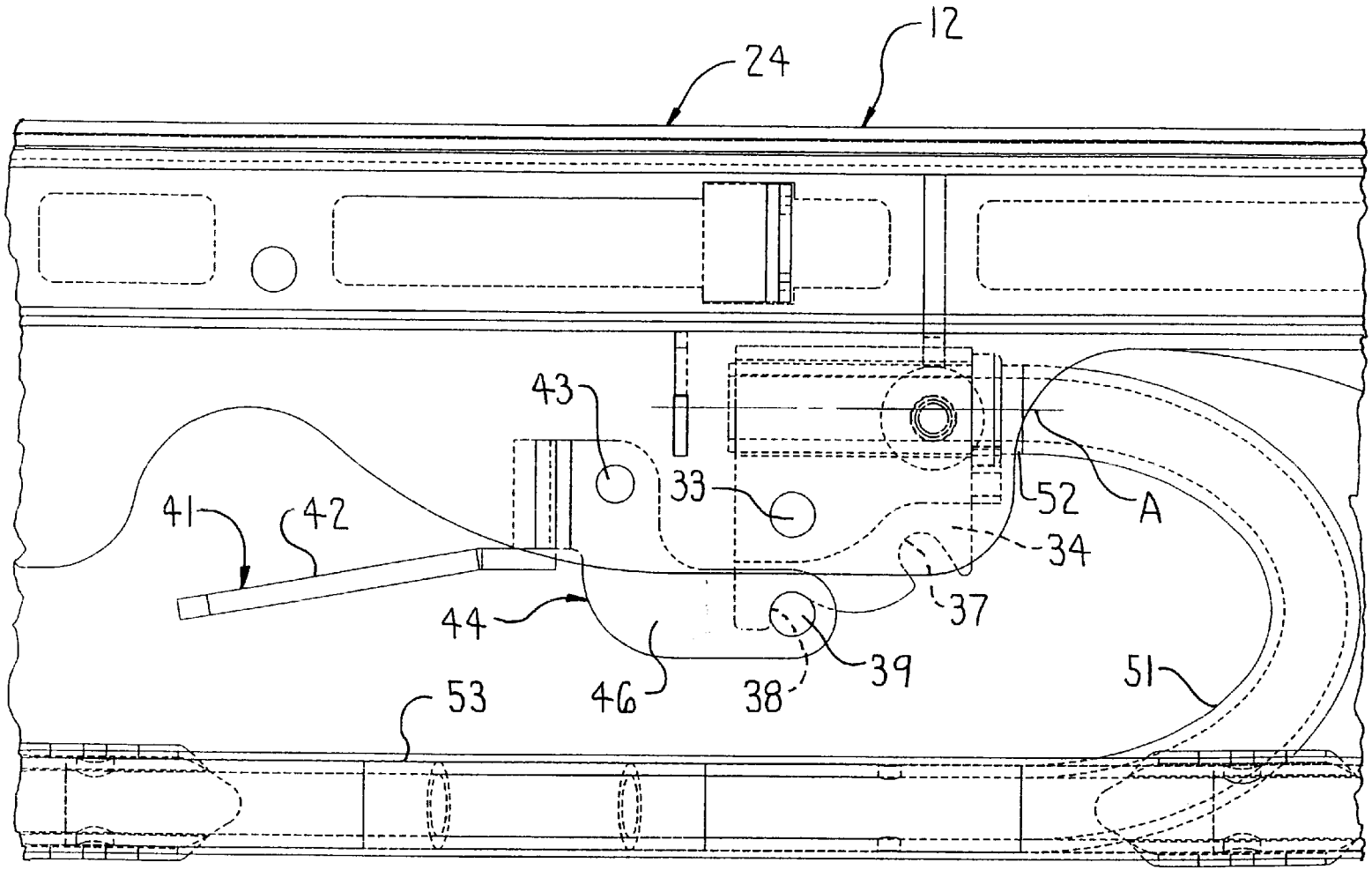
FIG. 8 is an enlarged side view of the fully retracted side rail.

One of the bearing housings 34, particularly the leftmost one in FIG. 2, has additional features on the exterior thereof, namely, a pair of recesses 37 and 38 into which is received a bar 39 of a latch mechanism 41 as shown in FIGS. 6, 7 and 8. The latch mechanism 41 includes a two arm lever construction, one arm 42 defining a handle pivotally secured to the side rail support frame 26 by an axle 43 extending between the plates 28 and 29. The second arm 44 of the two arm lever consists of two spaced apart lever arms 46 and 47 (FIG. 6) each secured to the handle 42 in FIG. 6, the axles 33 and 43 being only schematically illustrated. The aforementioned bar 39 extends between the two lever arms 46 and 47 and also straddle the one bearing housing 34 to facilitate reception of the bar 39 into the respective recesses 37 and 38. A torsion spring or the like (not illustrated) encircles the axle 43 (or the weight of the handle 42) to effect an urging of the bar 39 extending between the two lever arms 46 and 47 into engagement with the surface of the one bearing housing 34 in which is oriented the recesses 37 and 38. All other bearing housings 34 on a common side of the patient supporting surface are free of recesses 37 and 38.

The side rail construction 17 includes a plurality of J-shaped posts 51 corresponding in number to the number of bearing housings 34. Each J-shaped post 51 includes a short leg section 52, circular in cross section, and a long leg section 53. Each short leg section 52 extends into a hole 36 in the bearing housing 34 and is rotatably supported therein. A bearing sleeve 54 consisting of a low friction material, such as polyurethane, is oriented between the outside surface of the short leg 52 and the internally facing surface of the short leg 52 and the internally facing surface of the hole 36 to provide a stable rotation support for the short leg section 52 inside the hole 36. An annular collar 56 encircles the short leg section 52 and serves to limit the extent to which the short leg section 52 extends into the hole 36. If desired, a conventional nut 57 can be provided inside distal end portion of the short leg section 52 adjacent the distal end thereof for purposes of receiving a screw 58 therein for holding a washer 59 up against the distal end of the short leg section 52. The diameter of the washer 59 is larger than the diameter of the hole 36 as to prevent withdrawal of the short leg section 52 from the hole 36.

As is illustrated in FIG. 6, a pin 61 extends radially outwardly from the collar 56 and is adapted to engage a stop surface 62 for purposes of limiting the extent to which the short leg section 52 can rotate in the hole 36. In this particular embodiment, the stop surface 62 forms a part of the bearing housing 34.

The distal end of each of the long leg sections 53 of each J-shaped post 51 is secured through a bracket 63 to an elongate rail member 64. In this particular embodiment, the brackets 53 are each fixedly secured to the elongate rail member 64 and are pivotally fastened to the distal end of the long leg sections 53 via a pivot pin 66.

Operation

Although the operation of the side rail construction described above will be understood from the foregoing description by skilled persons, a summary of such description is now given for convenience.

Figure 3:
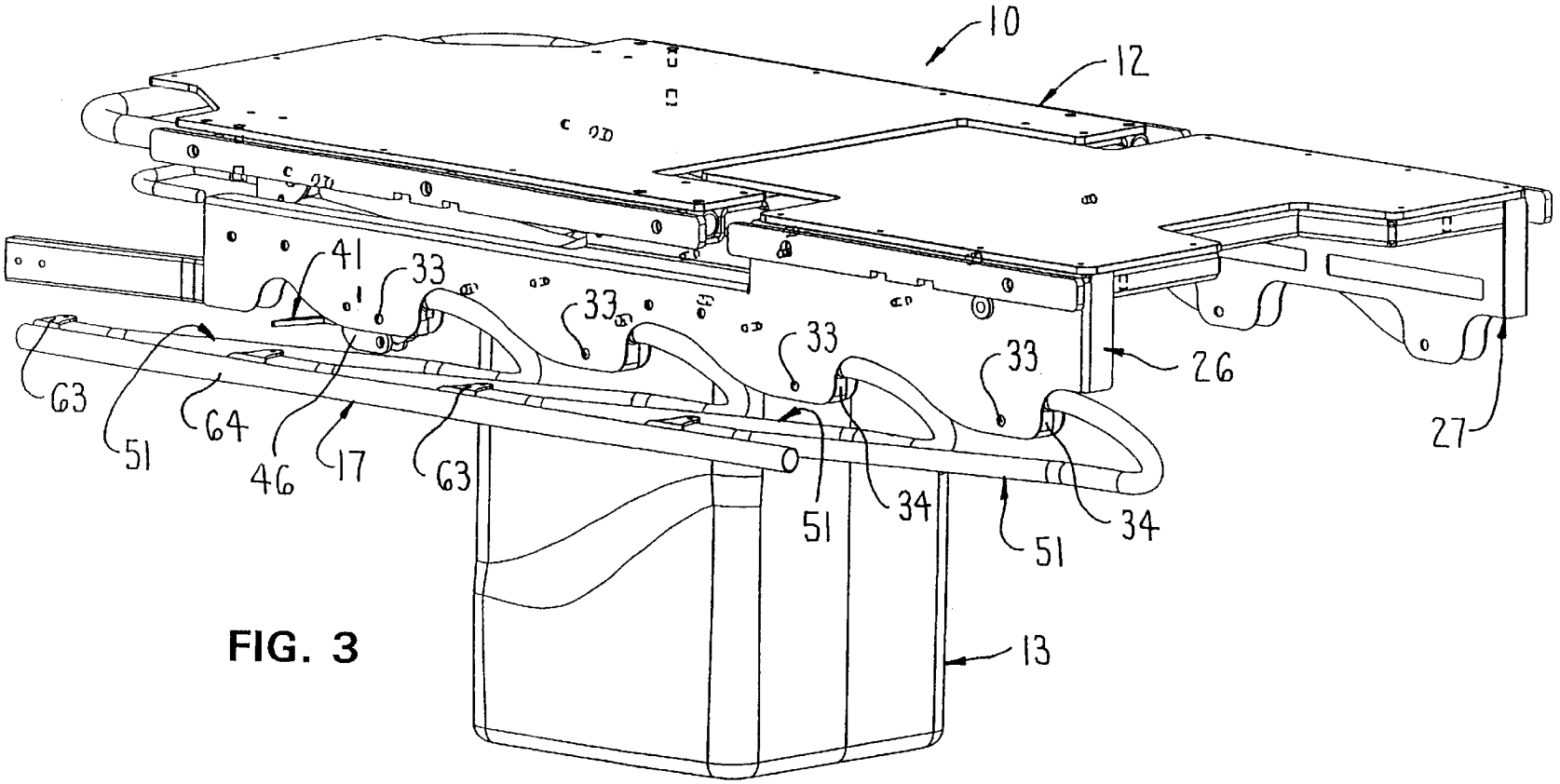
FIG. 3 is a view like FIG. 2, accept that the side rail construction is in the fully retracted position.
Figure 4:
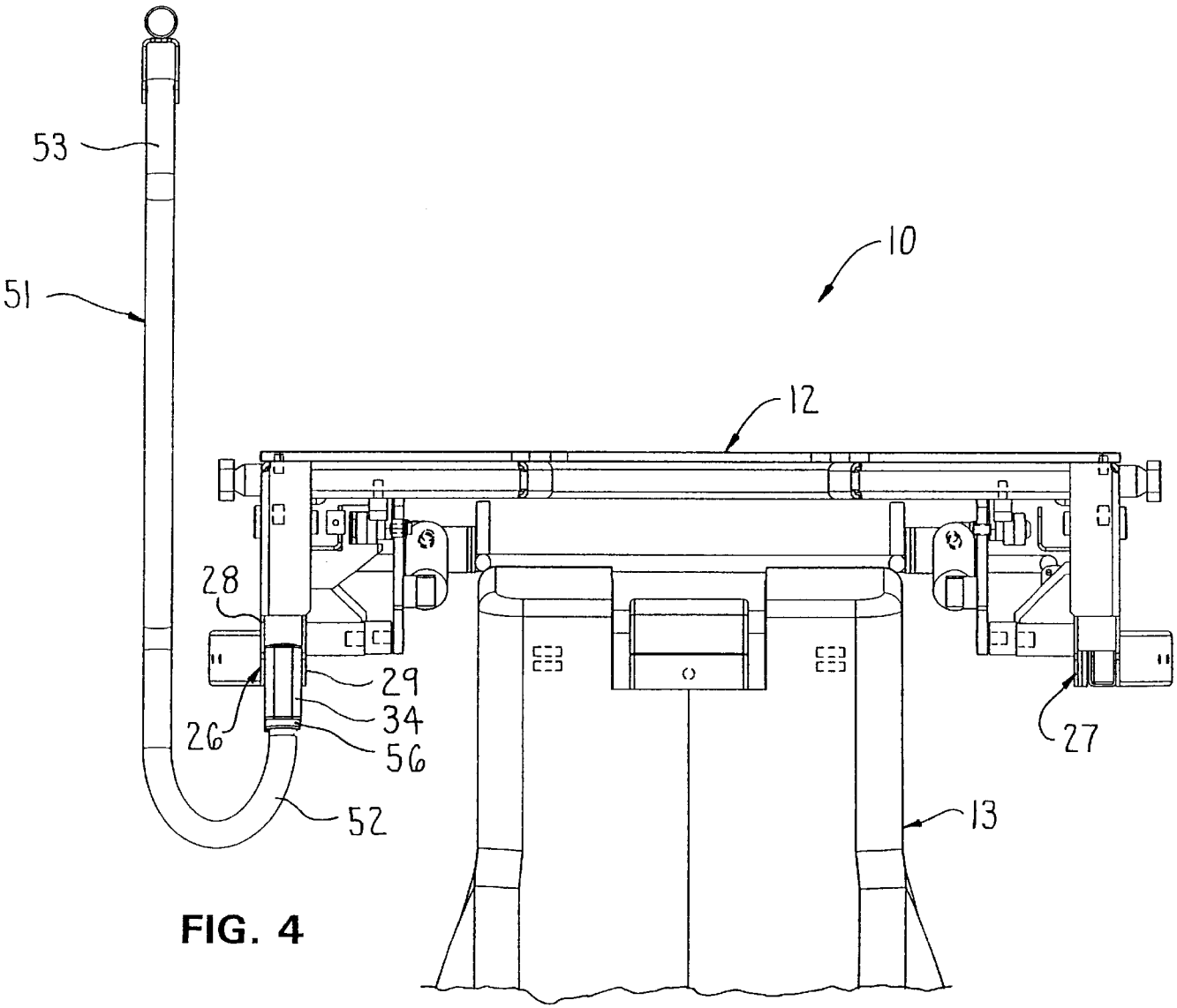
FIG. 4 is an end view of the deployed side rail construction.

If it is assumed that the side rail construction 17 is in the deployed position illustrated in FIG. 2, and it is desired to collapse the side rail construction to the position illustrated in FIG. 3, the attendant must first operate the latch mechanism 41 lifting the handle 42 thereof so as to cause the bar 39 to exit the recess 37 to thereby release the one bearing housing 34 to enable it and the remaining bearing housings 34 on a side of the patient supporting surface common therewith to pivot about the axes of the axles 33 from the position illustrated in FIG. 7 to the position illustrated in FIG. 8. During this transition, the bar 39 will move toward and eventually end in the recess 38 as depicted in FIG. 8. The not illustrated torsion spring (or the weight of the handle 42) will continually urge the bar 39 into engagement with a surface on the one bearing housing 34 to ensure entrance of the bar 39 into the selected recess 37 of 38. After the bearing housings 34 have all reached the position illustrated in FIG. 8, the central axes A of the holes 36 in each of the bearing housings 34 will move from the generally vertically upright oriented position illustrated in FIG. 7 to a horizontal position illustrated in FIG. 8, which position is, incidentally, coaxial with the axes A of all of the other openings in the other bearing housings on the aforesaid common side. This will facilitate a rotatable movement of the side rail construction 17 about the coaxial axes A from the broken line position illustrated in FIG. 5 to the solid line position thereof. In the solid line position, it will be noted that the elongate rail member 64 is actually oriented beneath the upwardly facing planar surface 24 of the patient support from 12 and generally flush with the lateral edge 19. As a result, the health care attendant can move in close to the lateral edge 19 of the patient support frame 12 to gain unobstructed access to the patient lying on a patient supporting surface defined by the upwardly facing surface of a mattress 18 of the like.

Figure 5:
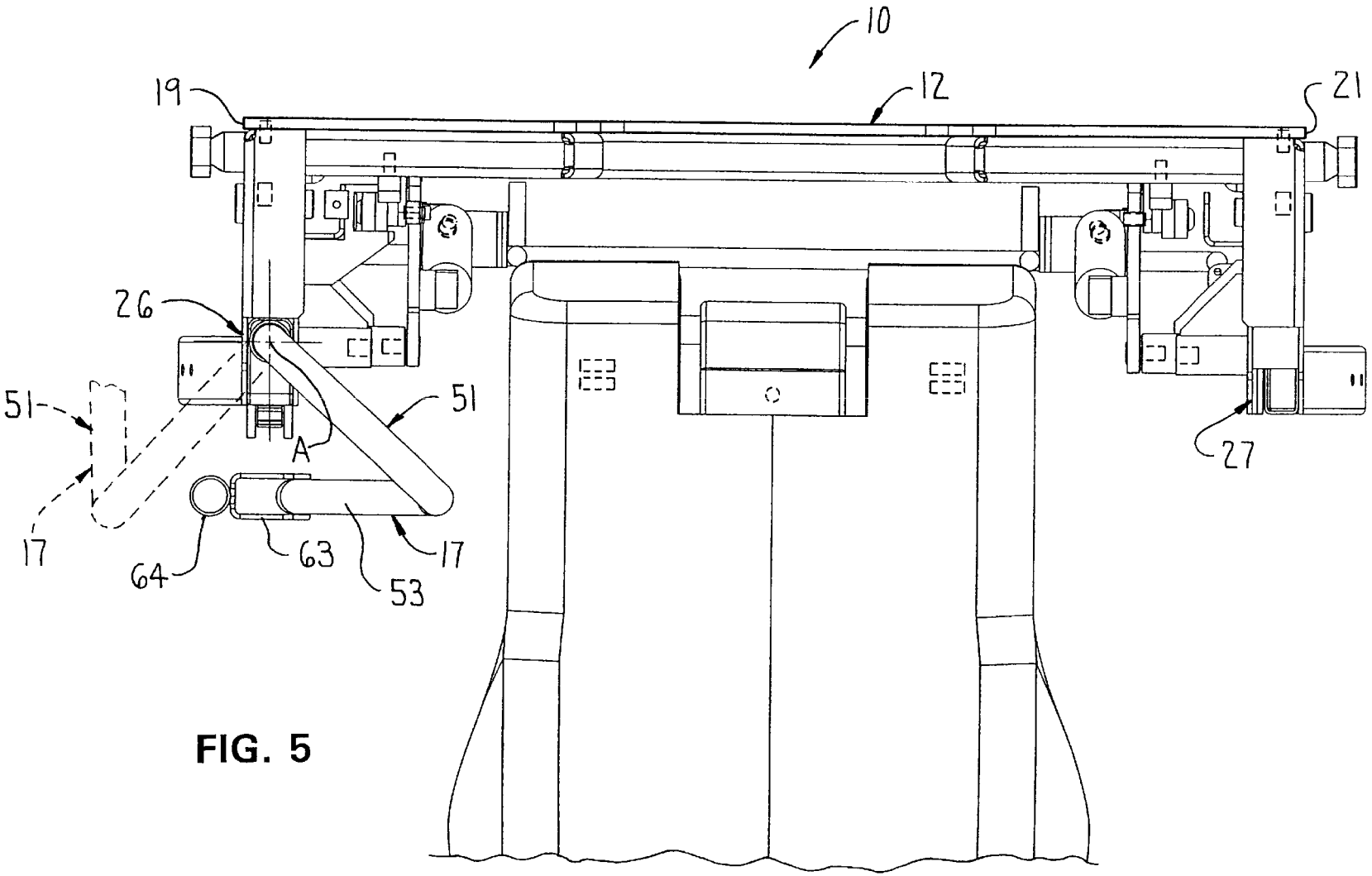
FIG. 5 is an end view of the fully retracted side rail construction.

To deploy the side rail construction 17, that is, move it from the position illustrated in FIG. 5 to the position illustrated in FIG. 2, the health care attendant need only pull out on the elongate rail member 64 causing the short leg sections 52 to rotate about the aligned axes A until the J-shaped posts 51 each reach the broken line position illustrated in FIG. 5 after which the attendant need only lift up on the elongate rail member 64 until the bar 39 on the latch mechanism 41 enters the recess 37 in the one bearing housing 34. The reception of the bar 39 in the recess 37 coupled with the torsion spring action (or weight of the handle 42) continually urging the bar 39 into the recess 37 will effect a locking of the side rail construction 17 in the deployed position illustrated in FIG. 2.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A side rail for a patient supporting bed, comprising:

a base;

a patient support frame mounted on said base, said patient support frame having thereon a patient supporting surface bounded by a head end, a foot end and lateral side edges;

a side rail support frame mounted on said patient support frame and extending coextensively with each of said lateral side edges;

a plurality of bearing housings each rotatably secured to said side rail support frame about parallel axes that extend horizontally and perpendicular to said lateral side edges, each said bearing housing having post receiving supports thereon whose central axis is movable with said bearing housing between first and second positions, said first position of each said central axis being axially aligned with other of said central axes of other of said post receiving supports on other of said bearing housings oriented on a common side of said patient supporting surface, said second position of each said central axis being displaced from said first position and parallel to other of said central axes of other of said post receiving supports on other of said bearing housings oriented on said common side of said patient supporting surface;

a plurality of posts, one end of each of which is received and rotatably supported in a respective one of said post receiving supports, an opposite end of each post oriented on said common side of said patient supporting surface being pivotally connected to a common elongate rail member also oriented on said common side of said patient supporting surface;

whereby each elongate rail member is oriented in a first position thereof above a plane of said patient supporting surface when said bearing housings are in said second positions thereof and oriented beneath said plane of said patient supporting surface and directly below said first position thereof when said bearing housings are in said first positions thereof, each said elongate rail member being movable to a third position in response to a rotation of respective posts on said post receiving supports on said bearing housings that are in said first position thereof, said third position of each said elongate rail being oriented intermediate said second position thereof and a vertically upright plane containing a central longitudinal axis of said patient supporting surface.

2. The side rail according to claim 1, wherein said post receiving supports on said bearing housings are each openings in the bearing housing into which is received one end of each respective post.

3. The side rail according to claim 2, wherein each opening is cylindrical in cross section and each said one end of each post is also cylindrical to facilitate rotation of a segment of said post received in said opening relative to said bearing housing.

4. The side rail according to claim 1, wherein at least one bearing housing on each lateral side includes means for operatively engaging a latch mechanism provided on said patient support frame to facilitate a locking of said plurality of posts and said elongate rail member affixes thereto in a deployed position corresponding to said second position of said bearing housings.

* * * * *